US006168270B1

(12) United States Patent
Saikawa et al.

(10) Patent No.: US 6,168,270 B1
(45) **Date of Patent: *Jan. 2, 2001**

(54) RECORDING APPARATUS HAVING A SHEET CONVEYING FORCE ADJUSTMENT SYSTEM

(75) Inventors: Satoshi Saikawa, Tokyo; Tetsuo Suzuki, Yokohama; Soichi Hiramatsu, Tokyo; Masahiro Taniguro; Hiroyuki Saito, both of Yokohama; Haruyuki Yanagi; Takashi Nojima, both of Tokyo; Hiroyuki Kinoshita, Kawasaki; Hideaki Kawakami, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/732,682

(22) Filed: Oct. 18, 1996

Related U.S. Application Data

(63) Continuation of application No. 08/170,782, filed on Dec. 21, 1993, now abandoned.

(30) Foreign Application Priority Data

Dec. 24, 1992 (JP) ..... 4-357457

(51) Int. Cl.[7] ..... B41J 2/01

(52) U.S. Cl. ..... 347/104; 271/119; 271/264

(58) Field of Search ..... 347/3.24, 114, 347/203, 16, 104; 346/134; 271/10.01, 114, 119, 256, 258.01, 264, 272, 265.01

(56) References Cited

U.S. PATENT DOCUMENTS

| | | | | |
|---|---|---|---|---|
| 3,737,158 | * | 6/1973 | Beery et al. | 271/258 X |
| 3,764,050 | * | 10/1973 | Clark | 226/31 |
| 4,437,656 | * | 3/1984 | Onoda et al. | 271/119 |
| 4,723,129 | * | 2/1988 | Endo et al. | 347/56 |
| 4,753,433 | * | 6/1988 | Rod et al. | 271/263 |
| 4,888,602 | * | 12/1989 | Watanabe | 347/104 X |
| 5,046,947 | | 9/1991 | Endoh et al. | 432/60 |
| 5,191,382 | | 3/1993 | Okamura et al. | 279/9 X |
| 5,335,043 | * | 8/1994 | Kluger et al. | 271/258 |
| 5,372,359 | * | 12/1994 | Miura et al. | 271/119 |

FOREIGN PATENT DOCUMENTS

| | | | | |
|---|---|---|---|---|
| 58-157654 | * | 9/1983 | (JP) | 271/258 |

* cited by examiner

*Primary Examiner*—John Barlow
*Assistant Examiner*—Craig Hallacher
(74) *Attorney, Agent, or Firm*—Fitzpatrick, Cella, Harper & Scinto

(57) ABSTRACT

In the sheet conveying apparatus, convey force of a convey device is changed according to the load applied to a recording sheet in order to constantly convey the recording sheet reliably. A rotary sheet discharge body has convex and concave portions in order to reliably discharge the recording sheet regardless of resistance applied to the recording sheet. Highly frictional material is provided only around the end portions of the rotary sheet discharge body in order to reduce the manufacturing cost and improve the facility of assembly.

22 Claims, 14 Drawing Sheets

RECORDING APPARATUS HAVING A SHEET CONVEYING FORCE ADJUSTMENT SYSTEM

This application is a continuation of U.S. application Ser. No. 08/170,782, filed Dec. 21, 1993, now abandonded.

BACKGROUND OF THE INVENTION

1. Field of the Invention

The present invention relates to a recording apparatus for letters, characters, images, and so on on a recording medium.

2. Related Background Art

FIG. 16 shows an example of a conventional recording apparatus, which comprises a sheet supply unit 210 for picking up recording sheets P, a conveyer unit 220 for conveying the recording sheets P from the sheet supply unit 210, a recording unit 230 for processing, for example printing, the recording sheets P conveyed by the conveyer unit 220, a sheet discharging unit 240 for discharging the processed recording sheets P, and a control device 250 for controlling sheet feed, conveyance and discharging.

More specifically, the control device 250 energizes a motor 251 to rotate a convey roller 221 and a pinch roller 222 of the conveyer unit 220. Then, torque is transmitted through a gear train 260 consisting of gears 261, 262, 263 and 264 to a sheet supply roller 211 of the sheet supply unit 210. On the surface of the sheet supply roller 211, a semi-circular rubber roller 212 is provided, which stands still with a clearance A between itself and the recording sheet P after the sheet supply roller 211 makes one rotation. Every time the sheet supply roller 211 makes one rotation, one recording medium on top of the stack of the recording sheets set in a base 213 is frictionally picked up by the rubber roller 212, led through the clearance A to be inserted between upper and lower guides 214 and 215, and positioned between a recording head 231 and a platen 232 of the recording unit 230 by the convey roller 221.

The recording head 231 processes, for example, prints line by line, the recording sheet P which is being conveyed by the convey roller 221. After processing is finished, discharging rollers 241 and spurs 243 of the sheet discharging unit 240 discharge the recording sheet P onto a tray 244.

Now, the above-mentioned conveyance operation which is controlled by the control device 250 using a sheet sensor 252 will be described with reference to the flowchart of FIG. 17.

First, when a conveyance command is applied to the control device 250 (step S1), the control device judges whether the sheet sensor 252 is turned on or off (step S2). If the sheet sensor is judged to be turned on, the control device 250 energizes the motor 251 and rotate the convey roller 221 at normal speed in order to feed the recording sheet P toward the recording unit 230 (step S3).

On the other hand, if the sheet sensor 252 is judged to be turned off in step S2, it means that the apparatus is in the initial state, where the recording sheet P does not exist between the upper guide 214 and the lower guide 215.

In this way, the conventional recording apparatus detects the recording sheet P by the sheet sensor 252 and drives the convey roller 221 at a predetermined normal speed when the recording sheet P is detected. After processing, for example, printing, the recording sheet P conveyed as described above is discharged onto the tray 244 by the discharging rollers 241 whose entire surfaces are covered with highly frictional material 242.

In this conventional apparatus, however, if the recording sheet P is present in the conveyer unit 220, the convey roller 221 is always driven at the predetermined normal speed regardless of the stand still postures of the sheet supply roller 211. Therefore in case the sheet supply roller 211 is in an abnormal stand still posture as shown in FIG. 18, where the round part of the rubber roller 212 is in contact with the rear portion of the recording sheet P, the recording sheet P to be conveyed receives the load from the rubber roller 212. Accordingly, conveyance failure may occur because the torque to rotate the convey roller 221 at normal speed is not sufficient to convey the recording sheet P.

To make provision for said case, the torque to drive the convey roller 221 may be increased. To do this, however, the rotating speed, that is, the conveyance speed of the recording sheet P has to be reduced, which deteriorates the performance of the recording apparatus.

In addition, in the conventional apparatus, since the entire surface of the discharging rollers 241 are covered with highly frictional material 242 such as rubber, the manufacturing cost of the apparatus is increased and assembly is not easy.

Further, in case where so many recording sheets P are discharged that the difference in level between an exit 242 and the discharged recording sheets P stacked on the tray 244 disappears, the fall for the recording sheet P to be newly discharged can not be obtained. In this case, the newly discharged recording sheet P is hampered by the frictional force and the electrostatic force of the recording sheets P previously ejected on the tray 244, and it is hard to completely eject only by the highly frictional material 242 such as rubber.

SUMMARY OF THE INVENTION

The present invention is made in order to solve the above-mentioned problems in the prior art. The object of the present invention is to provide a recording apparatus which can reliably convey the recording medium even the rotary sheet feed body gives a load to the recording medium, and which can reliably discharge the recording medium.

DETAILED DESCRIPTION OF THE PREFERRED EMBODIMENTS

Now, the present invention will be described with reference to its preferred embodiments.

Figure 1:
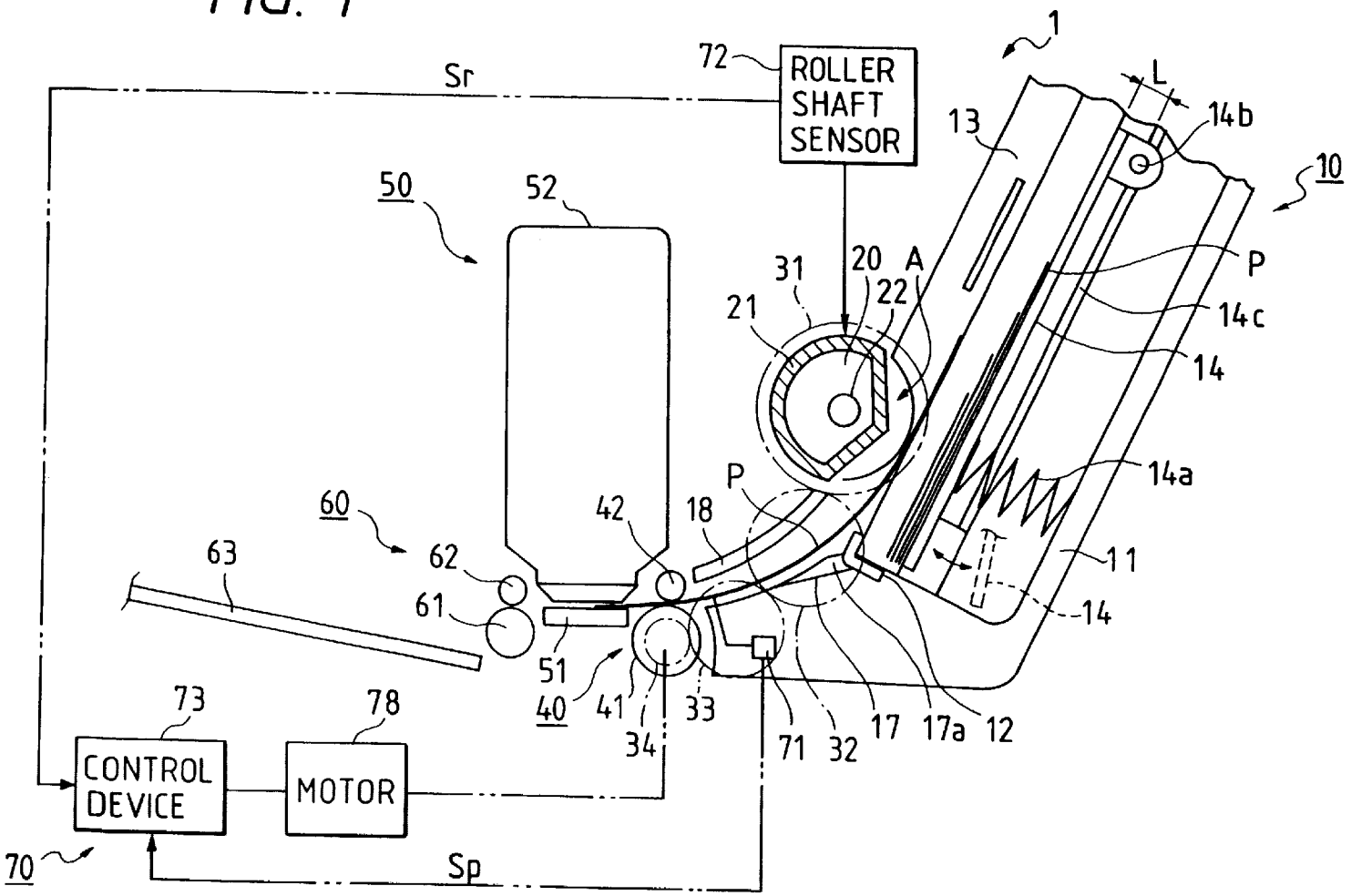
FIG. 1 is a cross-sectional view showing the first embodiment of the recording apparatus according to the present invention.
Figure 2:
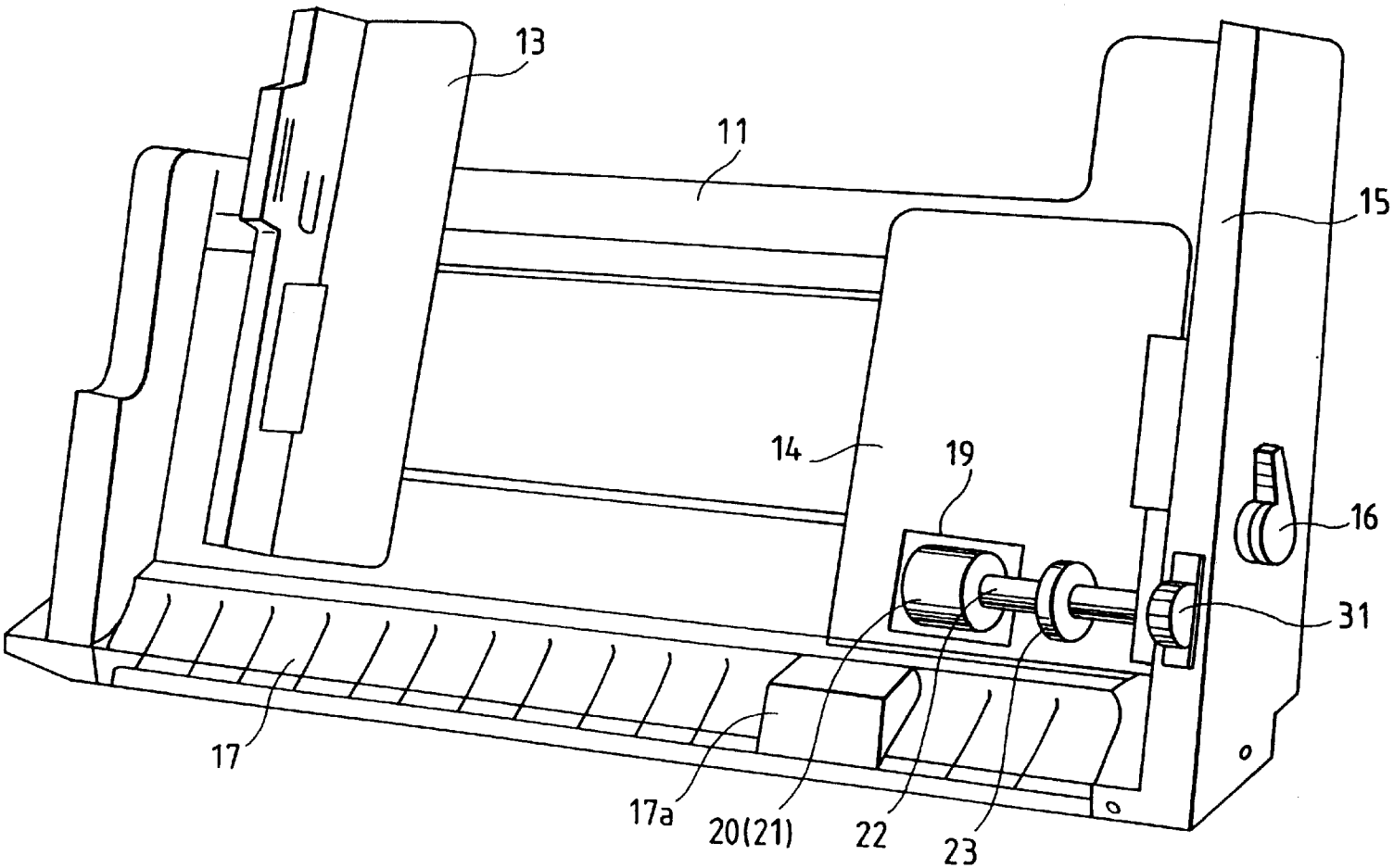
FIG. 2 is a perspective view showing the sheet supply unit of the apparatus shown in FIG. 1.

FIG. 1 is a cross-sectional view showing the first embodiment of the recording apparatus according to the present invention, and FIG. 2 is a perspective view showing a sheet supply portion of the recording apparatus.

As shown in FIG. 1, the recording apparatus 1 comprises a sheet supply unit (sheet feed means) 10 for picking up recording sheets P, a conveyer unit (conveyer means) 40 for conveying the recording sheets P from the sheet supply unit 10, a recording unit (recording means) 50 for processing, for example printing, the recording sheets P conveyed by the conveyer unit 40, a sheet ejection unit (ejection means) 60 for ejecting the processed recording sheets P, and a control unit (control means) for controlling sheet supply, conveyance and ejection.

As shown in FIGS. 1 and 2, the sheet supply unit 10 comprises of a base 11 having a separation claw 12 for separating the recording sheets P one by one, a moving side guide 13 which slides breadthways on the base 11, a pressure plate 14 biased by a pressure plate spring 14*a*, a release lever 16 (shown only in FIG. 2) provided to a fixed side guide 15 integrally formed with the base 11, and a sheet supply roller 20 serving as the rotary sheet feed body. The difference in level between a fix member 14*c* of the base 11 and the pressure plate 14 is adjusted to be within a range of 0 mm–10 mm, which reduces the load given to the recording sheets P and also realizes good positional relation between the sheet supply roller 20 and the recording sheets P. Thus, the recording sheets P can be supplied smoothly without skew feed.

The sheet supply roller 20, as well as an auxiliary roller 23, is set around a shaft 22 and connected with the conveyer portion 40 through a gear train comprising of gears 31, 32, 33 and 34. The sheet supply roller 20 has a substantially D-shaped cross section. A D-shaped or semi-circular roller rubber 21 is provided over the sheet supply roller 20. The sheet supply roller 20 is rotated to pick up the recording sheet P on the pressure plate 14 by bringing the round portion of the rubber roller 21 into frictional contact with the recording sheet P. After making one rotation, the sheet supply roller 20 stops with a clearance A through which the recording sheet P is fed. The auxiliary roller 23 rotatably set around the shaft has an outer diameter smaller than the outer diameter of the large diameter portion of the sheet supply roller 20 and larger than the small diameter portion thereof.

Incidentally, a separation pad 19, shown in FIG. 2, is arranged on the pressure plate 14 so as to be faced with the sheet supply roller 20, and is made of a material such as artificial leather having a relatively large coefficient of friction. The separation pad prevents a plurality of recording sheets P from being picked up at the same time, which sometimes occurs when there are not many recording sheets P left.

The conveyer unit 40 has a convey roller 41 serving as a rotary conveyer body rotated by a pulse motor 78, and a pinch roller 42 which is rotated together with the convey roller 41. The convey roller 41 and the pinch roller 42 are positioned to be in contact with each other downstream close to a lower guide 17 and an upper guide 18 so that the recording sheet P sent from the sheet supply portion 10 is pinched between these rollers and conveyed to the recording unit 50.

The recording unit 50 has a platen 51 for receiving the recording sheet P sent from the conveyer unit 40, and a recording head 52 for carrying out a recording operation on the recording sheet P on the platen 51 according to certain image information. The recording head 52 is that of ink jet type which is formed integrally with, for example, an ink tank and can be easily exchanged. More specifically, the recording head 52 has an electro-thermal converter and performs recording operation by applying thermal energy to ink to cause film boiling. Thus, pressure change caused as bubbles grow and shrink is utilized to discharge ink from discharge openings and print the recording sheet P.

After recording operation, the recording sheet P is ejected from the recording unit 50 onto a tray 63 of the ejection unit 60, which also has ejection rollers 61 and spurs 62 serving as rotary ejection bodies.

The control unit 70 has a sheet sensor 71 (the first detection means), a roller shaft sensor 72 (the second detection means), a control device 73, and a motor 78. The rotation of the convey roller 41 is controlled according to the signals from the sheet sensor 71 and the roller shaft sensor 72. The sheet sensor has a rockable member which is projected inside the space between the upper guide 18 and the lower guide 17 and moved when touched by the recording sheet P. The sheet sensor 71 detect the front edge of the recording sheet P by this rockable member and determines the print position on the surface of the recording sheet P. Further, when the recording sheet P touches the rockable member and turns on the sheet sensor 71, the sheet sensor 71 applies an ON-signal Sp to the control device 73. The roller shaft sensor 72 detects the stand still posture of the sheet supply roller 20. If the sheet supply roller 20 is not in a normal stand still posture, the roller shaft sensor 72 is turned on to apply an ON-signal Sr to the control device 73.

Figure 3:
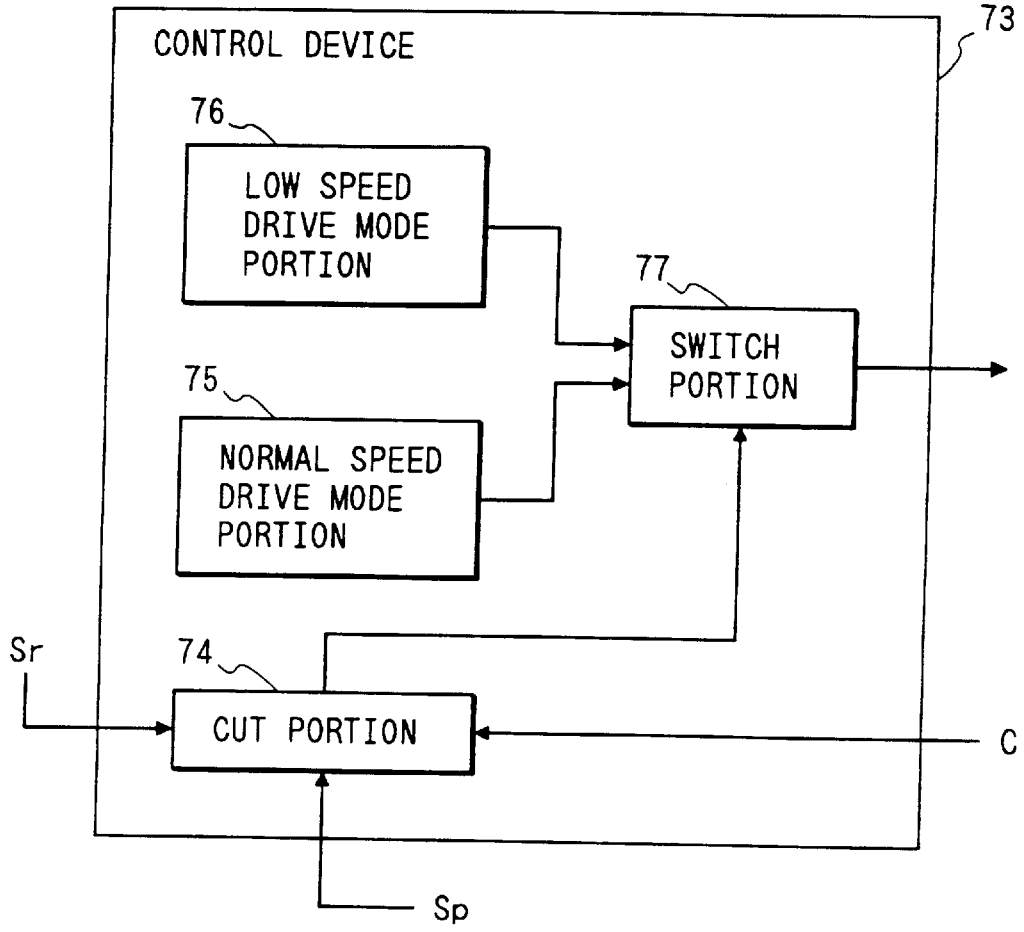
FIG. 3 is a block diagram of the control device of the apparatus shown in FIG. 1.

As shown in FIG. 3, the control device 73 comprises a cut portion 74, a normal speed drive mode portion 75, a low speed drive mode portion 76, and a switch portion 77 for switching these mode portions 75 and 76.

When the cut portion 74 receives a conveyer command signal C from, for example, a computer (not shown), the presence/absence of the ON-signals Sp and Sr from the sheet sensor 71 and the roller shaft sensor 72 is checked. Based on the presence/absence of these signals, the switch portion 77 switches the mode portions 75 and 76.

More specifically, if the applied conveyance command signal C is not followed by the ON-signal Sp sent from the sheet sensor 71, the cut portion 74 judges that the apparatus is in the initial state. If the sheet sensor 71 is turned on and the ON-signal Sp is applied, the presence/absence of the ON-signal Sr from the roller shaft sensor 72 is detected. When the ON-signal Sr is not detected, the cut portion 74 has the switch portion 77 select the normal speed drive mode portion 76 to rotate the motor 78 at normal speed. On the other hand, when the ON-signal Sr is detected, the switch portion 77 selects the low speed drive mode portion 76 to drive the motor 78 at low speed.

The normal speed drive mode portion 75 controls the rotation of the motor 78 so as to rotate the convey roller 41 at normal speed, while the low speed drive mode 76 rotates the convey roller 41 at a speed smaller than said normal speed in order to increase the torque of the convey roller 41. To realize such control, many well known mechanisms such as a gear switching mechanism can be used.

Next, sheet supply, conveyance, sheet and ejection of the recording apparatus 1 will be briefly described.

When the release lever 16 of the sheet supply unit 10 is released, the pressure plate spring 14*a* is biased to rock the pressure plate 14 around a pressure plate shaft 14*b*. Then, the pressure plate 14 is separated from the sheet supply roller 20, as indicated by the broken line in FIG. 1. Then, the front edges of the recording sheets P are brought into contact with a tilted plate 17*a* of the lower guide 17 to be trued up. Further, the left edge (with respect to the travelling direction, that is, substantially downward in FIGS. 1 and 2) of the recording sheets P are brought into contact with the left fixed side guide 15 to be lined up by shifting the movable side guide 13. Thus, the recording sheets P are properly positioned. Subsequently, the release lever 16 is locked so that the pressure plate 14 is pressed by the pressure plate spring 14*a* and returned to its previous position. At the same time, the recording sheets P pressed against the sheet supply roller 20 are set, wherein if the sheet supply roller 20 is in the normal stand still posture the top recording sheet P is in contact with the auxiliary roller 23.

After setting the recording sheet P, the torque of the motor 78 is transmitted through the convey roller 41 and the gear train 30 to the sheet supply roller 20. The sheet supply roller 20 makes one rotation to pick up recording sheets P and stops. Then, the stand still posture of the sheet supply roller 20 is detected by the roller shaft sensor 72. The picked-up recording sheets P, which are further separated by the separation claw 12, are sent one by one between the upper guide 18 and the lower guide 17 to the conveyer unit 40.

When the recording sheet P reaches the convey unit 40, the sheet sensor 71 is turned on to detect the front edge of the recording sheet P and determine the print position. The recording sheet P conveyed on the platen by the conveyer unit 40 is subjected to recording process of the recording head 52. After recording process, the recording sheet P is ejected on the tray 63 by the sheet ejection rollers 61 and the spurs 62 of the ejection unit 60.

Figure 4:
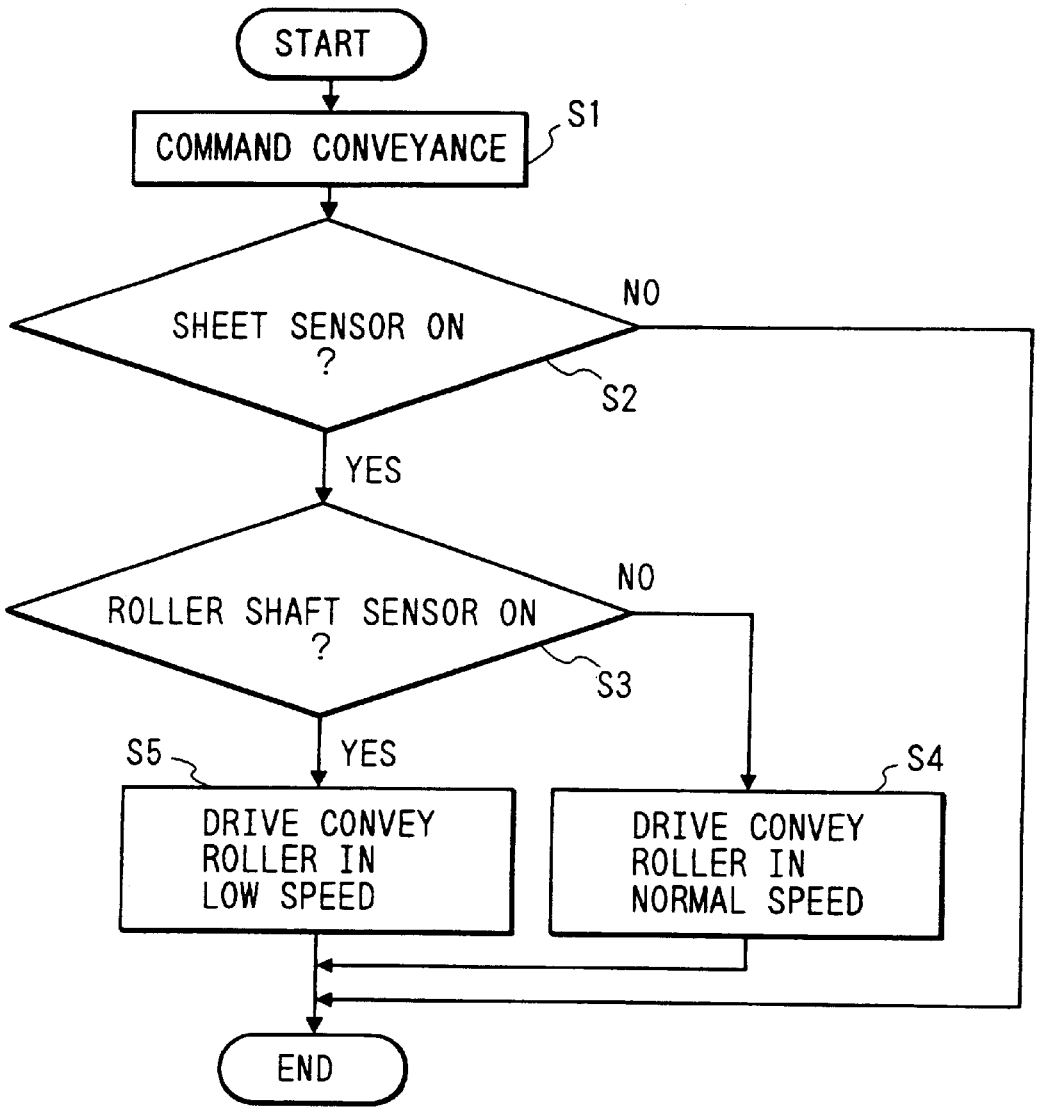
FIG. 4 is a flowchart for the conveyance operation of the apparatus shown in FIG. 1.
Figure 5:
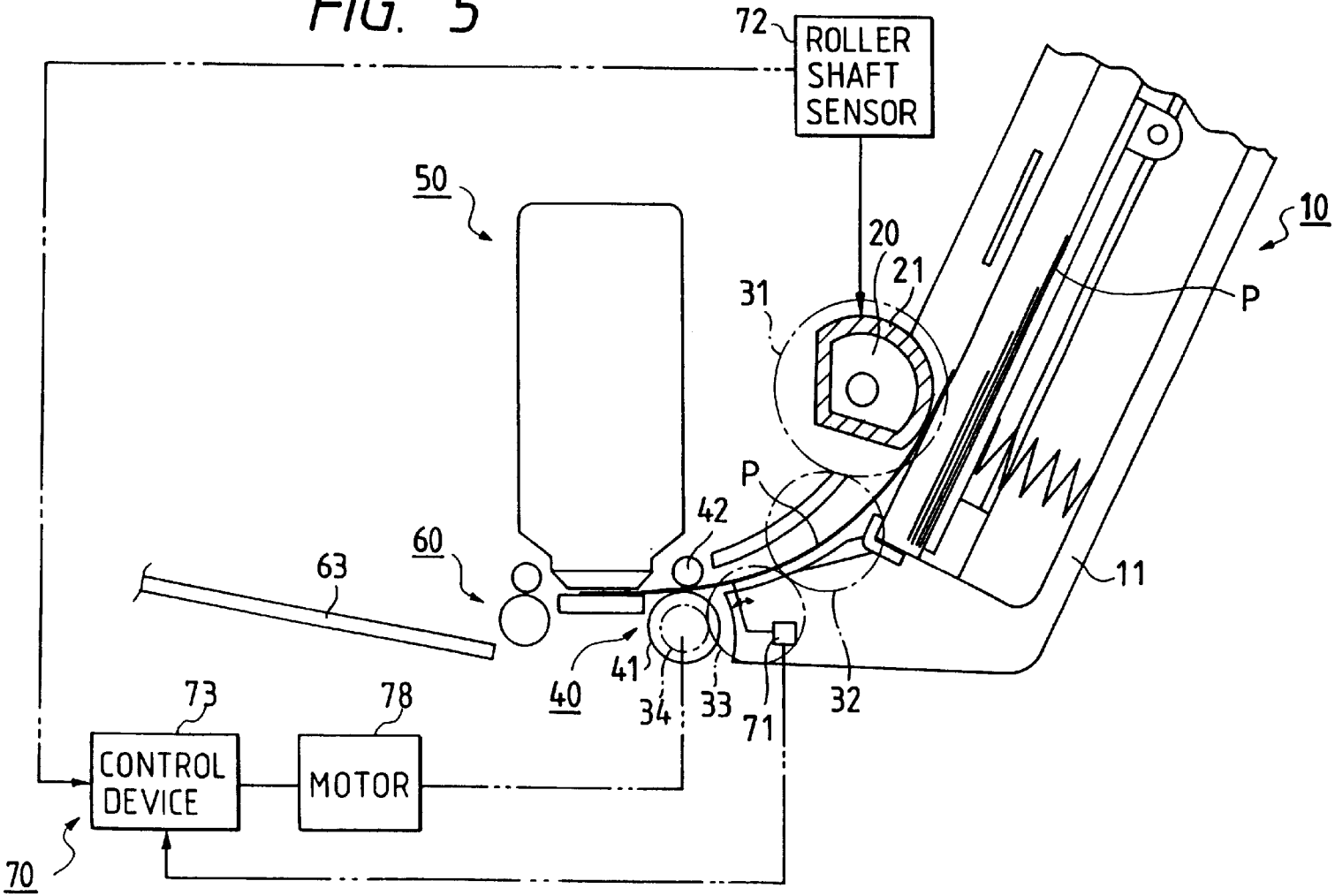
FIG. 5 is a cross-sectional view showing the sheet supply roller of the apparatus shown in FIG. 1 in the abnormal stand still posture.

Now, the conveyance operation control performed by the control unit 70, which characterizes this embodiment, will be described in detail with reference to the flowchart of FIG. 4.

When the cut portion 74 in the control device 73 receives the conveyance command signal C (step S1 in FIG. 4), the cut portion judges whether the sheet sensor 71 is turned on or not (step S2).

In case the recording sheet P is not supplied from the sheet supply unit 10 to the conveyance unit 40, the sheet sensor 71 is not turned on and the sheet sensor 71 does not send the ON-signal Sp. So, if the ON-signal Sp is not received, the cut portion 74 judges that the apparatus 1 is in the initial state. On the other hand, if the recording sheet P from the sheet supply unit 10 reaches the conveyance unit 40, the rockable member touched by the recording sheet P turns on the sheet sensor 71 and the cut portion 74 receives the ON-signal Sp from the sheet sensor 71. In this case, the cut portion 74 further judges whether the roller shaft sensor 72 is turned on or not (step S3).

The sheet supply roller 20 in the initial posture makes one rotation to pick up a recording sheet P and send it to the conveyer unit 40, and then stop. If the sheet supply roller 20 stands still with the clearance A through which the recording sheet P is sent as shown in FIG. 1, that is, if the sheet supply roller 20 is in the normal stand still posture, the roller shaft sensor 72 is not turned on and does not apply the ON-signal Sr to the cut portion 74. Accordingly, the cut portion 74 has the switch portion 77 select the normal speed drive mode portion 75 to drive the motor 78 at normal speed (step S4). As a result, the recording sheet 20 which does not receive the load from the sheet supply roller 20 is quickly conveyed, and the apparatus returns in the initial state.

On the other hand, if the sheet supply roller 20 stands still with its rubber roller 21 brought in contact with the recording sheet P, that is, if the sheet supply roller 20 is in the abnormal stand still posture, the roller shaft sensor 72 is turned on and applies the ON-signal Sr to the cut portion 74. Accordingly, the cut portion 74 has the switch portion 77 select the low speed drive mode 76 to drive the motor 78 (step S5). As a result, the convey roller 41 rotated at low speed but by larger torque can convey the recording sheet P against the load given by the sheet supply roller 20. After that, the apparatus comes into the initial state.

In this embodiment, as described above, since the rotating speeds of the convey roller 41 are switched according to whether the sheet supply roller 20 is in the normal stand still posture or not, the recording sheet P can be reliably conveyed even if the sheet supply roller 20 is in the abnormal stand still posture.

Now, the second embodiment of the present invention will be described with reference to the drawings.

Figure 6:
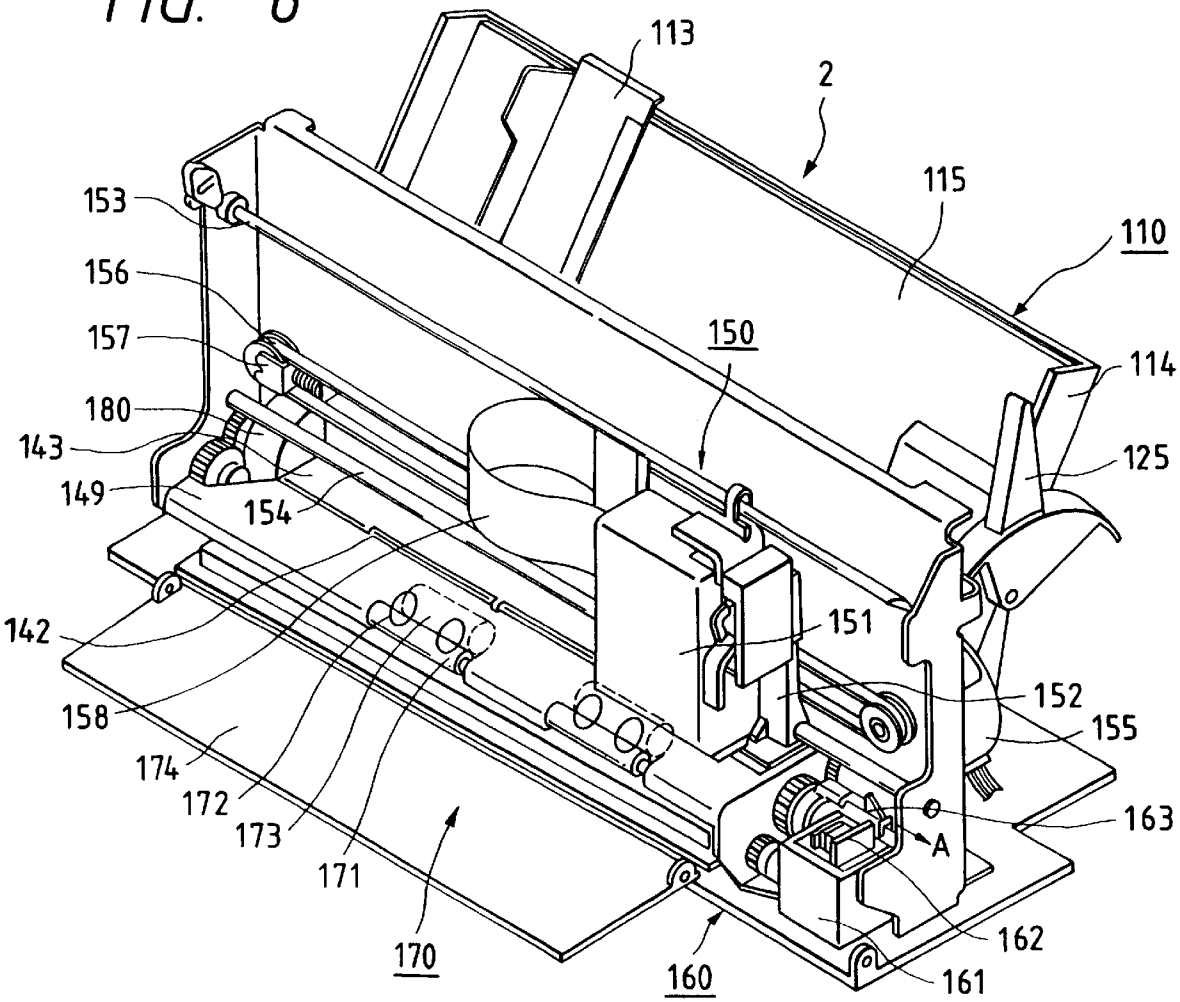
FIG. 6 is a perspective view showing the second embodiment of the recording apparatus according to the present invention.
Figure 7:
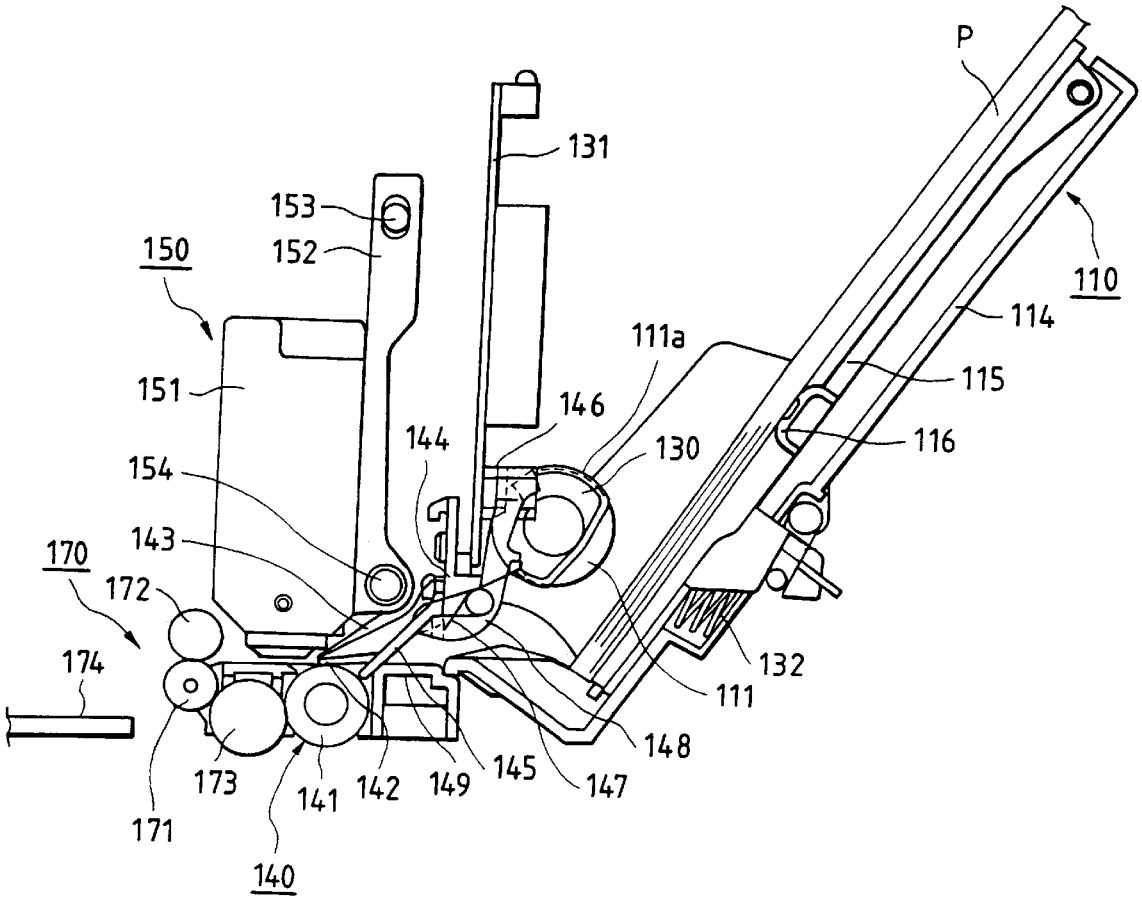
FIG. 7 is a cross-sectional view showing the recording apparatus shown in FIG. 6.
Figure 8:
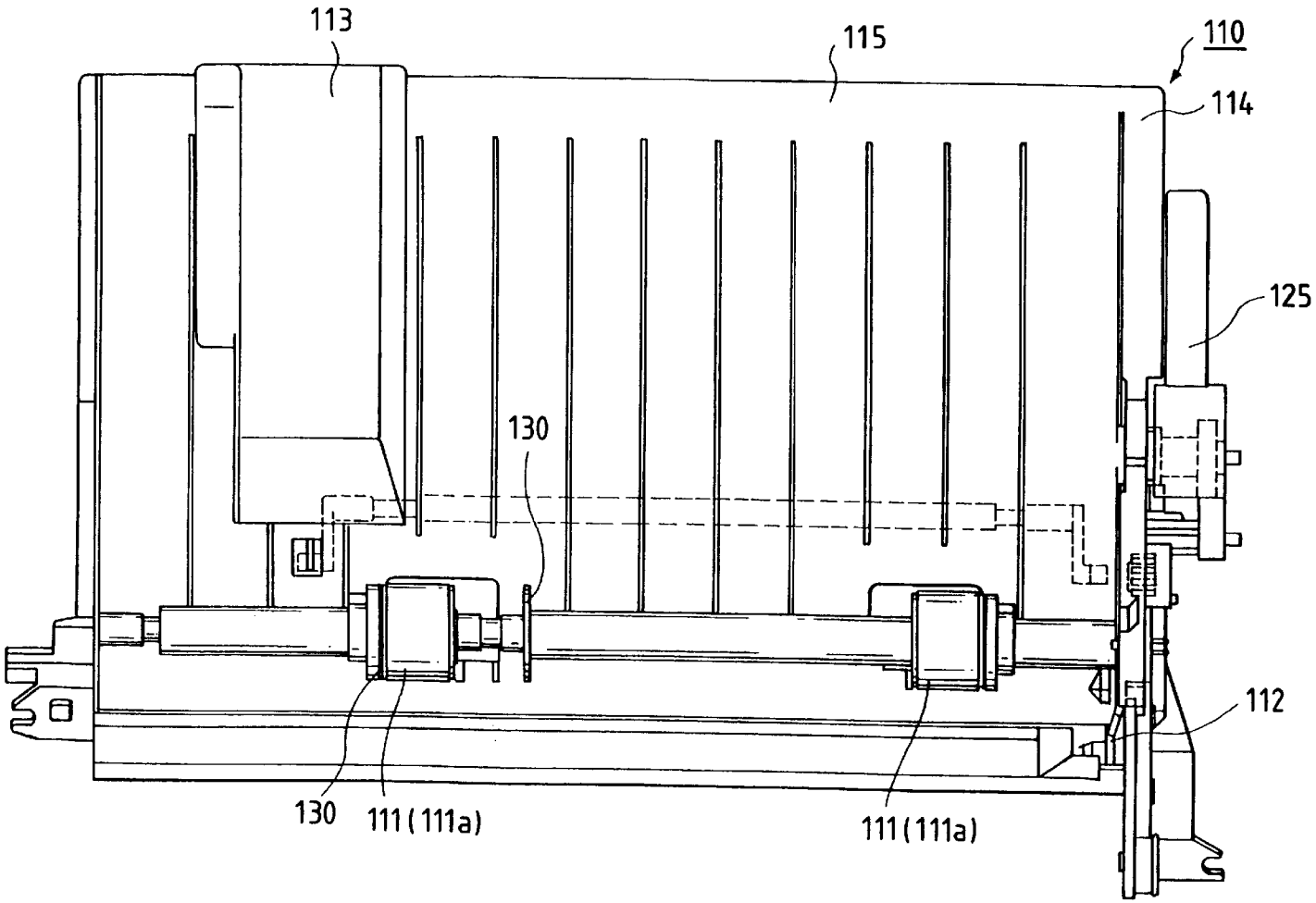
FIG. 8 is a front view of the sheet supply unit of the apparatus shown in FIG. 6.
Figure 9:
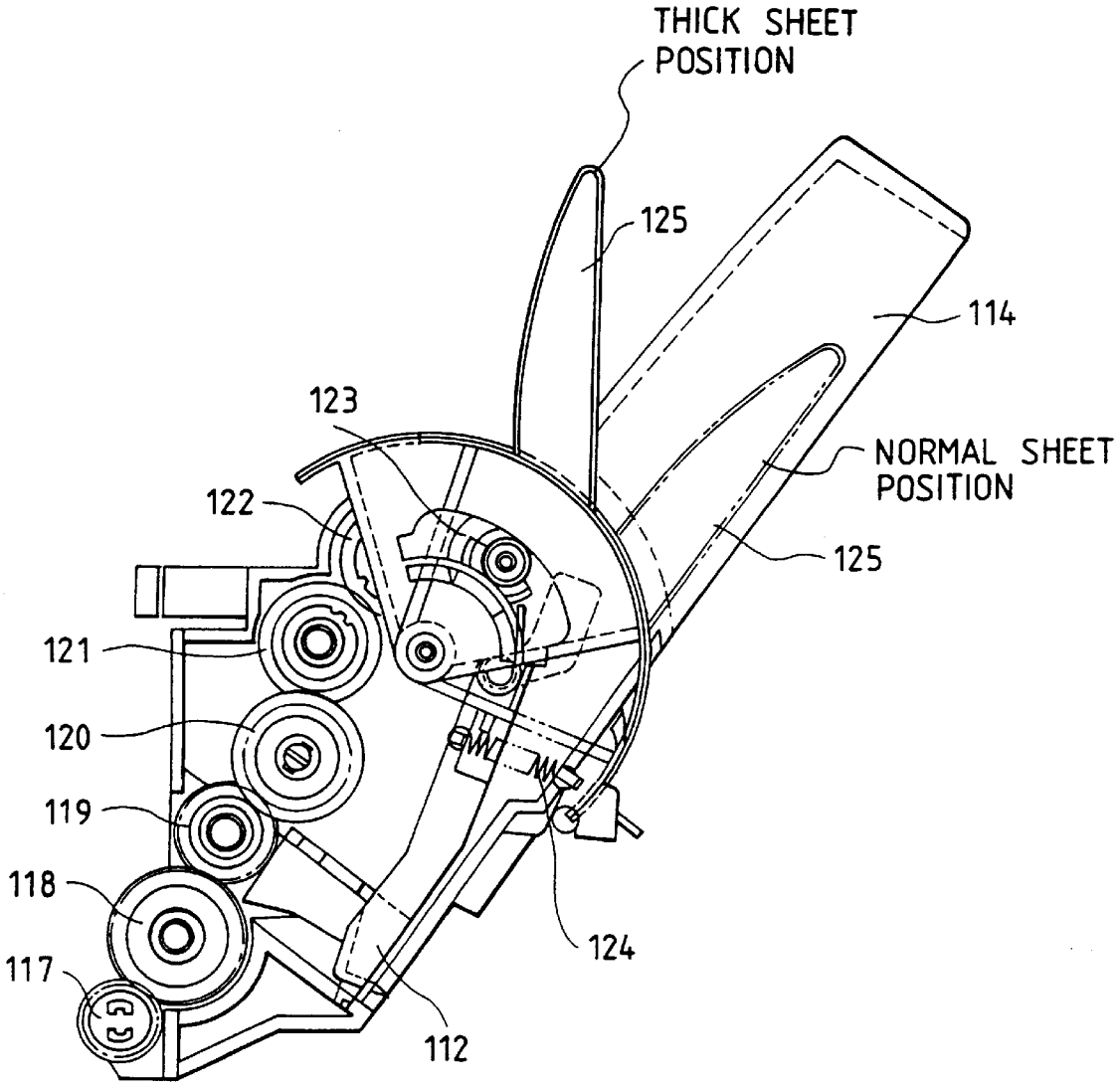
FIG. 9 is a side view showing the sheet supply unit of the apparatus shown in FIG. 6.

FIG. 6 is a perspective view of the second embodiment of the recording apparatus according to the present invention. FIG. 7 is a cross-sectional view of the same. FIGS. 8 and 9 are, respectively, a front view and a side view of the sheet supply unit of the second embodiment.

As shown in FIGS. 6 and 7, the recording apparatus 2 of the second embodiment is a recording apparatus with which an automatic sheet supply device is integrated, comprises a sheet supply unit 110; a conveyer unit 140, a recording unit 150, a cleaning unit 160, and a sheet ejection unit 170.

The sheet supply unit 110 is attached to the apparatus main body at an angle of 30 °–60° thereto, and the recording sheets P set in the apparatus are horizontally ejected after printing. As shown in FIGS. 8 and 9, the sheet supply unit 110 comprises a sheet supply roller 111 serving as a rotary sheet feed body, a separation claw 112, a moving side guide 113, a base 114, a pressure plate 115 biased by a pressure plate spring (not shown), a driving gear train consisting of gears 117 to 122, a release cam 123, a claw spring 124, and an operation lever 125. Usually the release cam 123 presses down the pressure plate 115 toward the base 114, so the recording sheets P are separated from the sheet supply roller 111.

When the recording sheets P are set in the apparatus, torque of the convey roller 141 shown in FIG. 7 (which is described later) is transmitted through the gear train of the gears 117 to 122 to the sheet supply roller 111 and the release cam 123. As the release cam 123 is separated from the pressure plate 115, the pressure plate 115 goes up to bring the recording sheets P into contact with the sheet supply roller 111. The sheet supply roller 111 rotates to pick up the recording sheets P, which are separated one by one by the separation claw 112 to be sent to the conveyer unit 140. The sheet supply roller 111 as well as the release cam 123 makes one rotation to send the recording sheet P to the conveyer unit 140, and then stops rotation with the recording sheets P separated therefrom by returning to the pressure plate to its previous position. Thus the apparatus stands still in the initial state.

The sheet supply rubber 111 has a roller 111*a* and a sensor plate 130 whose radius is smaller than that of the rubber roller 111*a*. The sensor plate 130 is notched to shield, from light, a roller sensor 132 including a photo interrupter directly provided on an electric substrate 131, and so on, except when the sheet supply roller 111 and the release cam 123 are in the initial state, as shown in FIG. 7, to release the pressure plate 115. By detecting the state of the sensor plate 130, the angular posture of the sheet supply roller 111 and the angular posture of the release cam 123 whose phase is adjusted with that of the sheet supply roller 111 can be checked. As a result, the timing of the supply of the recording sheet P can be properly controlled.

As shown in FIG. 7, the conveyer unit 140 comprises the previously-mentioned convey roller 141 serving as a rotary conveyer body, a pinch roller 142, a pinch roller guide 143, a pinch roller spring 144, a PE sensor lever 145, a PE sensor 146, a PE sensor spring 147, an upper guide 148, and a platen 149.

The recording sheet P sent to the conveyer unit 140 is guided by the platen 144, the pinch roller guide 143 and the upper guide 148 to a pair of rollers, the convey roller 141 and the pinch roller 142. Before the roller pair, the PE sensor lever 145 is provided, which detects the front edge of the recording sheet P to determine the print position on the surface of the recording sheet P. The pinch roller spring 144 biases the pinch roller guide 143, which presses the pinch roller 142 against the convey roller 141. Thus, carrying force to convey the recording sheet P is obtained. The pair of rollers 141 and 142 rotated by an LF motor 180 shown in FIG. 6 convey the recording sheet P on the platen 149 to the recording unit 150.

As shown in FIGS. 6 and 7, the recording unit 150 comprises a recording head 151, a carriage 152 for supporting the recording head 151, guides 153 and 154 for guiding the carriage in the direction vertical to the conveyance direction of the recording sheet P so that the recording head 151 can be subjected to main scanning, a carriage motor 155, a timing belt 156 for transmitting driving force of the carriage motor 155 to the carriage 152, idle pulleys 157 around which the timing belt is set, and a flexible substrate 158 for transmitting head drive signals from the electric substrate 131 to the recording head 151.

The recording head 151 is an ink jet recording head which performs a printing operation of the recording sheet P according to certain image information. The recording head is formed integrally with an ink tank and can be easily exchanged. More specifically, the recording head 151 has an electro-thermal converter and performs a recording operation by applying thermal energy to ink to cause film boiling. Thus, pressure change caused as bubbles grow and shrink is utilized to discharge ink from discharge openings and print the recording sheet P. As the carriage motor 155 and the LF motor 180, step motors which rotate in arcs corresponding to signals from a driver (not shown) are used.

The cleaning unit 160 for cleaning the recording unit 150, as shown in FIG. 6, comprises a pump 161 used for cleaning the recording head 151, a cap for preventing the recording head 151 from being dried, and a switch arm 163 for selectively transmitting the driving force from the convey roller 141 to either the sheet supply unit 110 or the pump 161. The switch arm 163 remains at the position shown in FIG. 6 except when the sheet supply operation or the cleaning operation is performed, and holds an epicyclic gear (not shown) rotatably set around the shaft of the convey roller 141 at a predetermined position. So, the driving force of the convey roller 141 is not transmitted to the sheet supply unit 110. However, when the carriage 152 is slid to shift the switch arm 163 in the direction indicated by the arrow A in FIG. 6, the epicyclic gear is rotated by the convey roller 141. If the convey roller 141 rotates normally, driving force is transmitted to the sheet supply unit 110. On the other hand, when the convey roller 141 rotates reversely, driving force is transmitted to the pump 161.

As shown in FIGS. 6 and 7, the sheet ejection unit 170 comprises sheet ejection rollers 171 and spurs 172 serving as a pair of rotary ejection bodies which are in contact with each other and rotate at the same time, transmission rollers 173 for transmitting the driving force of the convey roller 141 to the sheet ejection rollers 171, and a tray 174 for receiving the recording sheet P which is ejected by the sheet ejection roller 171 and the spurs 172. Since the transmission rollers 173 are pressed against the convey roller 141 by a transmission spring (not shown), the torque of the convey roller 141 is transmitted through the transmission rollers 173 to the sheet ejection rollers 171.

Figure 10:
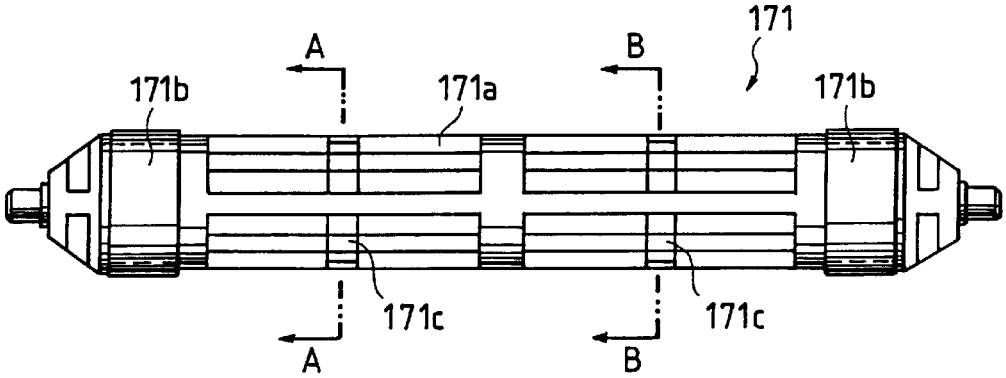
FIG. 10 is a front view of the discharging roller of the apparatus shown in FIG. 6.
Figure 11:
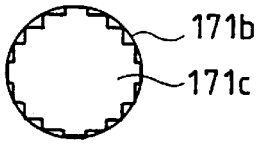
FIG. 11 is a view showing the cross section of the discharging roller shown in FIG. 10, seen as indicated by arrows A or B in FIG. 10.

As shown in FIGS. 10 and 11, each ejection roller 171 comprises a roller main body 171*a*, which is a rotating main body, and rubber roller 171*b* provided around the surface of the end portions of the roller main body 171*a*, which serve as highly frictional members. As the roller rubber 171*b* is provided only around the end portions and with narrow width, instead of around the entire surface of the roller main body 171*a*, not only the manufacturing cost can be reduced but the facility of assembly is improved.

Further, two convex and concave portions protruding stepwise circumferentially are formed in the roller main body 171*a* so as to be in contact with the respective spurs 172. The outer diameter of the convex and concave portions 171*c* is determined to be equal to the outer diameter of the rubber roller 171*b*. Thus, the roller main body 171*b* with the convex and concave portions 171*c* can reliably eject the recording sheet P. More specifically, when so many recording sheets P are ejected that the difference in level between an exit 175 and the ejected recording sheets P stacked on the tray 174 disappears and the fall for the recording sheet P to be newly ejected can not be obtained, the newly ejected recording sheet P is hampered by the frictional force and the electrostatic force of the recording sheets P previously ejected on the tray 174. In this case, the recording sheet P is hard to completely eject only by the frictional roller rubber 171*b*, and the ejected recording sheet P may be stopped halfway. However, when the convex and concave portions 171*c* are formed, the recording sheet P is strongly nipped between the convex and concave portions 171*c* of the sheet ejection rollers 171 and the spurs 172, the recording sheet P can be certainly ejected regardless of the frictional force and the electrostatic force hampering the recording sheet P.

Figure 12:
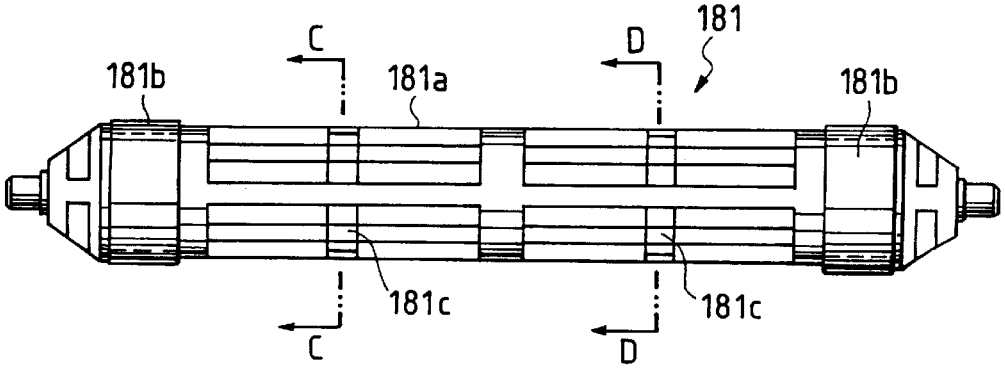
FIG. 12 is a front view showing the first modification of the discharging roller of the apparatus shown in FIG. 6.
Figure 13:
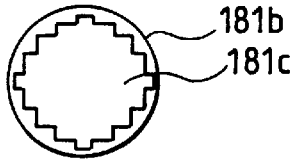
FIG. 13 is a view showing the cross section of the discharging roller shown in FIG. 12, seen as indicated by arrows C or D in FIG. 12.

FIGS. 12 and 13 show the first modification of the sheet ejection roller.

The sheet ejection roller 181 differs from the above-mentioned sheet ejection rollers 171 in that convex and concave portions 181 formed around a roller main body 181*a* have an outer diameter smaller than that of rubber roller 181*b*. With said construction, the distance between the recording head 151 and the recording sheet P can be reduced, and at the same time, an irregular surface of the recording sheet P which is caused by ink in the span direction of a sheet path can be prevented.

Figure 14:
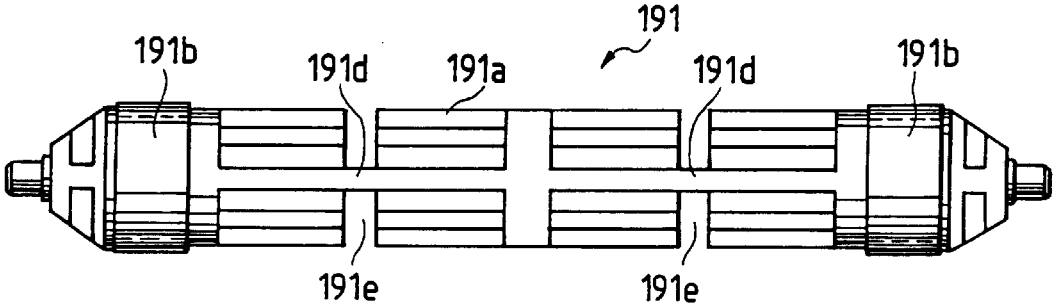
FIG. 14 is a front view showing the second modification of the discharging roller of the apparatus snown in FIG. 6.
Figure 15:
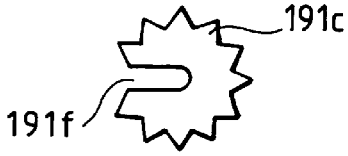
FIG. 15 is a side view showing the convex and concave portion of the second modification of the discharging roller shown in FIG. 14.
Figure 16:
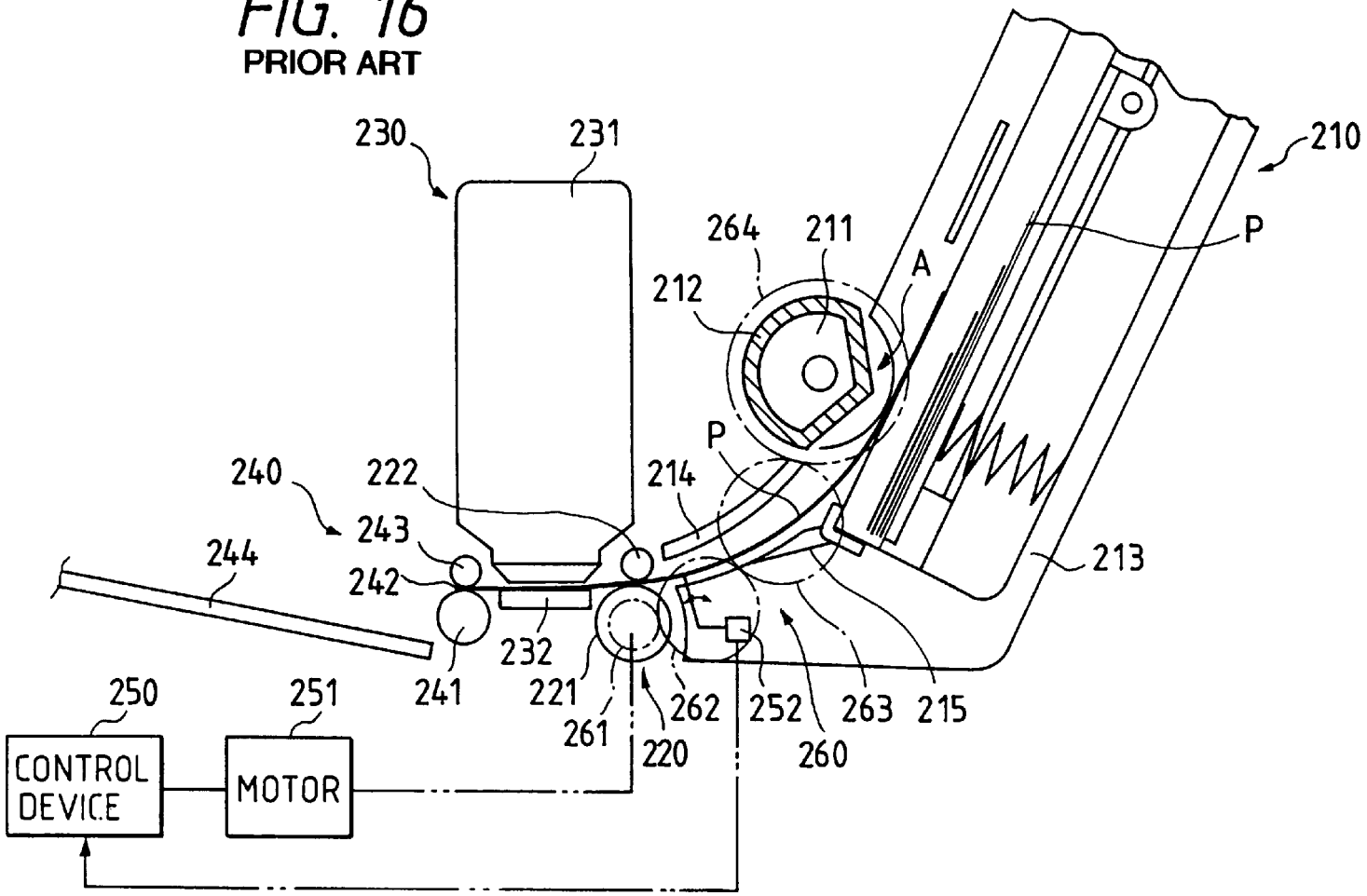
FIG. 16 PRIOR ART
FIG. 16 is a cross-sectional view showing a conventional recording apparatus.
Figure 17:
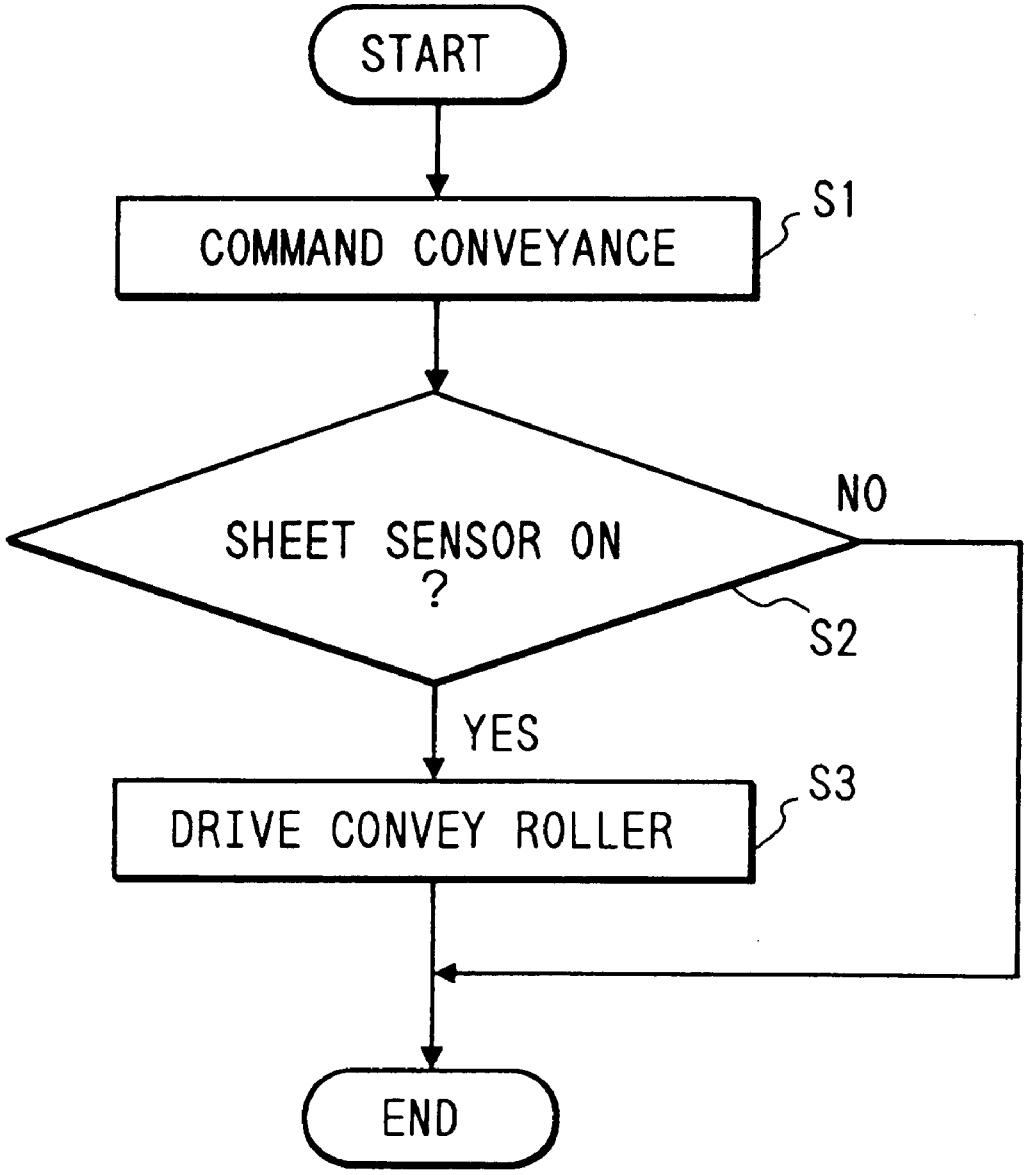
FIG. 17 PRIOR ART
FIG. 17 is a flowchart for the conveyance operation of the conventional apparatus.
Figure 18:
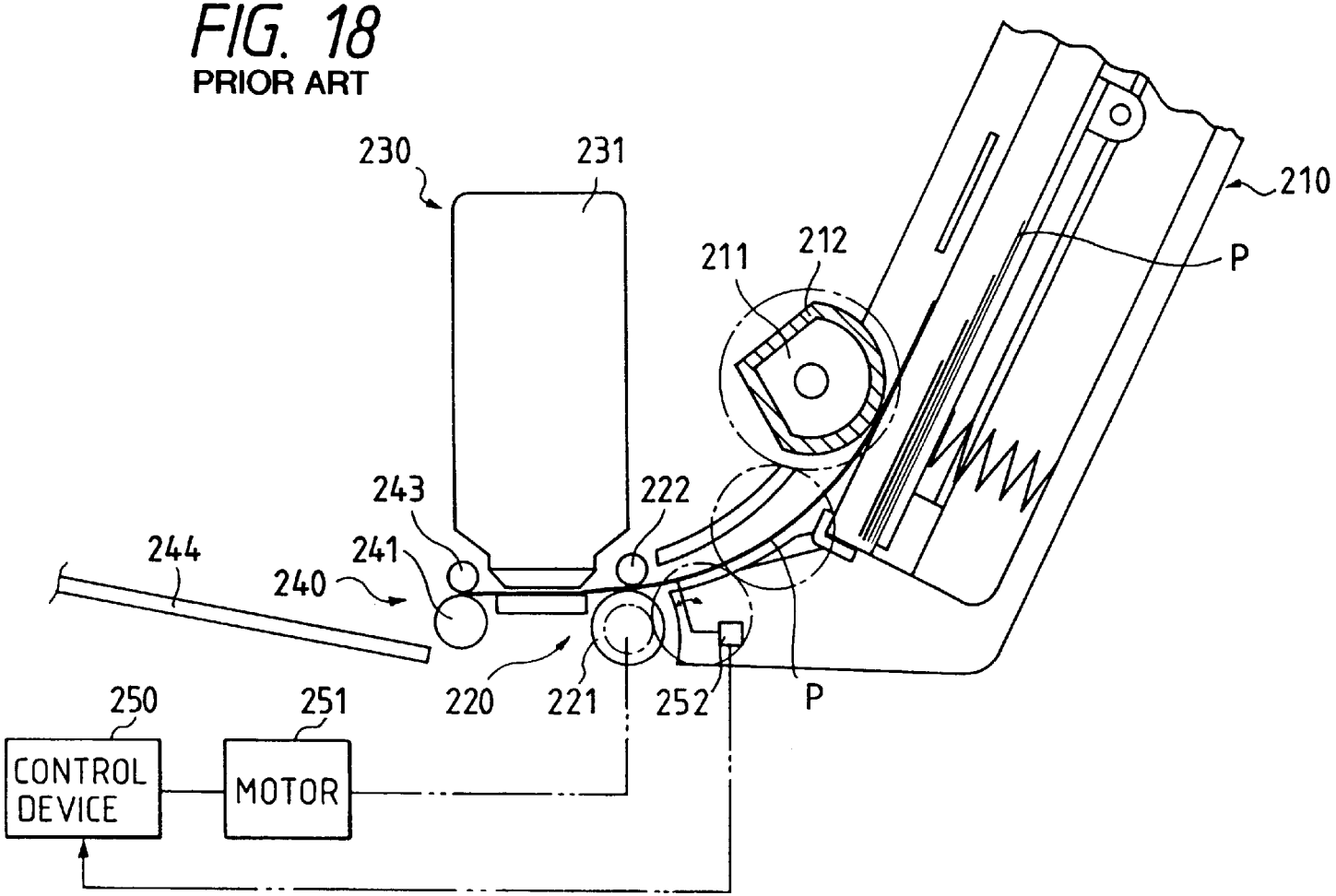
FIG. 18 PRIOR ART
FIG. 18 is a cross-sectional view showing the sheet supply roller of the conventional apparatus in the abnormal stand still posture.

FIGS. 14 and 15 show the second modification of the sheet ejection roller.

The sheet ejection roller 191 differs from the above-mentioned sheet ejection rollers 171 and 181 in that a roller main body 191*a* and convex and concave parts 191*c* are separately formed. More specifically, in the roller main body 191*a* having roller rubber 191*b* around its end portions, concave portions 191*e* are formed with respective engaging portions 191*d*. In each convex and concave part 191*c* formed separately from the roller main body 191*a*, a notched portion 191*f* to engage with the engaging portion 191*d* is formed. The convex and concave part 191*c* is inserted in the concave portion 191*e* so as to engage the notched portion 191*f* with the engaging portion 191*d*. Thus, the convex and concave part 191*c* is attached to the roller main body 191*a*.

As the convex and concave portions 191*c* are separately formed, they can be more easily formed. So, the shape can be freely designed. For example, when the convex and concave part 191*c* has a starlike shape sharply protruding outward in radial directions, as shown in FIG. 15, more reliable sheet ejection operation is possible. Or, the convex and concave part 191*c* may be made of a material different from that of the roller main body 191*a*. For example, metal convex and concave parts 191*c* can eject the recording sheet P more effectively.

Note that the sheet ejection rollers 61 in the apparatus 1, the first embodiment, can, of course, be replaced by the sheet ejection rollers 171, 181 and 191 in the apparatus 2, the second embodiment.

According to the above-mentioned construction and operation of the present invention, first, since the carrying force of the conveyance means is changed according to the load given to the recording medium by the rotary sheet feed body of the sheet feed means, the recording medium can be reliably conveyed against the load. Secondly, since the rotary ejection bodies for ejecting the recording medium have convex and concave portions (or carry convex and concave parts), the recording medium can be certainly ejected even if it is hampered. In addition, high frictional material is provided only around the end portions of the rotary ejection bodies, the manufacturing cost can be reduced and the facility of assembly improved.

What is claimed is:

1. A sheet conveying apparatus, comprising:

stack means for stacking a sheet thereon;

a rotary supply member having a small-diameter portion and a large-diameter portion, said rotary supply member supplying the sheet by rotatingly contacting with the sheet stacked on said stack means at the large-diameter portion but not contacting with the sheet at the small-diameter portion;

convey means for conveying the sheet supplied by said rotary supply means;

drive means for driving said convey means;

detection means for detecting whether said rotary supply member is in a predetermined state where the small-diameter portion is opposed to said stack means; and control means for controlling said drive means so that the convey force of said convey means is increased when said detect means detects said rotary supply member is not in the predetermined state.

2. A sheet conveying apparatus according to claim 1, wherein said drive means has a motor, and said control means controls a rotational speed of the motor when said detection means does not detect the predetermined state of said rotary supply member.

3. A sheet conveying apparatus according to claim 1, said drive means comprising a pulse motor for driving said convey means, wherein said control means changes the convey force by changing the rotating speed of the pulse motor.

4. A sheet conveying apparatus according to claim 1, further comprising recording means for performing a recording operation on the sheet conveyed by said convey means.

5. A sheet conveying apparatus according to claim 4, wherein said recording means forms ink droplets by thermal energy, and records images with the ink droplets.

6. A sheet conveying apparatus comprising:

convey means for conveying a sheet;

a rotary supply member arranged upstream with respect to said convey means for feeding one sheet from a stacked sheet bundle to said convey means, said rotary supply member having a large-diameter portion capable of contacting with the sheet and a small-diameter portion not contacting with the sheet;

first detection means for detecting whether said rotary supply member contacts with the sheet;

second detection means for detecting an increase in the conveying load of the sheet generated by contacting the stopped rotary supply member with the sheet; and control means for controlling said convey means so that a conveying force of said convey means increases, to continue the sheet conveying when said second detection means detects an increase in the conveying load.

7. A sheet conveying apparatus according to claim 6, wherein said detection means detects whether said large diameter portion of said rotary sheet supply body contacts the sheet.

8. A sheet conveying apparatus according to claim 7, wherein said control means increases the convey force of said convey means when said detection means detects that said large diameter portion of said rotary sheet supply body contacts the sheet.

9. A sheet discharging apparatus having a rotating body for discharging a sheet out of a main body of said sheet discharging apparatus, wherein said rotating body has a first portion where a plurality of convex portions and a plurality of concave portions are arranged alternately around said rotating body in a circumferential direction thereof, and a second portion different from the first portion where a high frictional member is disposed around said rotating body in a circumferential direction thereof, wherein a cross section of said rotating body is point symmetry with respect to a rotational center thereof, and wherein a protrusion of a plurality of convex and concave portions is selected to be smaller than the outer diameter of said high frictional material.

10. A sheet discharging apparatus according to claim 9, wherein said high frictional material is provided on a peripheral surface of said rotating body at at least one portion other than said plurality of convex and concave portions.

11. A sheet discharging apparatus according to claim 1, wherein said plurality of convex and concave portions are provided on a body separate from a main body of said rotating body and attached thereto.

12. A sheet discharging apparatus according to claim 11, wherein said plurality of convex and concave portions are made of a material different from a material of the main body of said rotating body.

13. A sheet discharging apparatus according to claim 9, further comprising recording means for forming images on the sheet, wherein said rotating body discharges the sheet on which said image is recorded by the recording means.

14. A sheet discharging apparatus according to claim 13, wherein said recording means forms ink droplets by thermal energy and records the image with the ink droplets.

15. A sheet conveying apparatus having a rotating body for conveying a sheet out of a main body of said sheet conveying apparatus, wherein said rotating body has a first portion where a plurality of convex portions and a plurality of concave portions are arranged alternately around a full circumference of the first portion in a circumferential direction thereof, and a second portion different from the first portion where a high frictional member is disposed around a full circumference of the second portion in a circumferential direction thereof to be contacted with the sheet, the first and second portion rotating integrally upon rotation of said rotating body, wherein a cross section of said rotating body is point symmetry with respect to a rotational center thereof, and wherein a protrusion of a plurality of convex and concave portions is selected to be smaller than the outer diameter of said high frictional material.

16. A sheet conveying apparatus, comprising:

stack means for stacking sheets thereon;

a rotary supply member having a small-diameter portion and a large-diameter portion, said rotary supply member rotating while contacting with the sheet, stacked on said stack means, at the large-diameter portion, to feed out the sheet, but not contacting with the sheet at the small-diameter portion;

convey means for conveying the sheet fed out by said rotary supply member by a predetermined conveying force;

drive means for driving said convey means;

detection means for detecting whether said rotary supply member is in a predetermined state in which the small-diameter portion thereof opposes said stack means; and control means for controlling said drive means so that said convey means conveys the sheet by a force larger than the predetermined conveying force, when said detection means does not detect that said rotary supply member is in the predetermined state in conveying the sheet fed out by said rotary supply member by said convey means.

17. A sheet conveying apparatus according to claim 16, wherein said drive means comprises a pulse motor, and said control means reduces a rotation speed of the motor when said detection means does not detect the predetermined state of said rotary supply member.

18. A sheet conveying apparatus according to claim 16, further comprising sheet detection means disposed between said rotary supply means and said convey means for detecting the sheet, wherein said control means controls said drive means so that, when said sheet detection means detects the sheet, the conveying force of said convey means increases when said detection means does not detect that said rotary supply means is in the predetermined state.

19. A sheet conveying apparatus according to claim 16, wherein said control means controls said drive means so that, after completion of sheet supplying by said rotary supply member and when said convey means conveys the sheet fed out by said rotary supply member, said convey means conveys the sheet by a force larger than the predetermined conveying force, when said detection means does not detect that said rotary supply means is in the predetermined state.

20. A sheet conveying apparatus according to claim 16, further comprising record means for recording on the sheet conveyed by said convey means.

21. A sheet conveying apparatus according to claim 16, wherein said record means comprises an ink jet recording head.

22. A sheet conveying apparatus according to claim 16, wherein said ink jet recording head discharges the ink by growth of a bubble generated by thermal energy.

* * * * *

UNITED STATES PATENT AND TRADEMARK OFFICE

CERTIFICATE OF CORRECTION

PATENT NO. : 6,168,270 B1
DATED : January 2, 2001
INVENTOR(S) : Satoshi Saikawa, et al.

It is certified that error appears in the above-identified patent and that said Letters Patent is hereby corrected as shown below:

Column 5,
Line 18, "sheet and" should read -- and sheet --.

Column 6,
Line "stop." should read -- stops. --.

Column 7,
Line 15, "roller" should read -- rubber roller --.

Column 8,
Line 58, "roller rubber" should read -- rubber roller --.

Column 9,
Line 16, "roller rubber" should read -- rubber roller --.

Column 11,
Line 1,"claim 1," should read -- claim 10, --.

Column 12,
Line 39, "claim 16," should read -- claim 20,--.
Line 42, "claim 16," should read -- claim 21,--.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*